US011219941B2

(12) United States Patent
Motz et al.

(10) Patent No.: US 11,219,941 B2
(45) Date of Patent: Jan. 11, 2022

(54) INGOT MOLD AND PROCESS FOR MANUFACTURING A CRANKCASE

(71) Applicant: Bayerische Motoren Werke Aktiengesellschaft, Munich (DE)

(72) Inventors: Christian Motz, Munich (DE); Konrad Reitmeier, Pfeffenhausen (DE); Andreas Schrattenberger, Munich (DE); Thomas Wagner, Reichertshausen (DE)

(73) Assignee: Bayerische Motoren Werke Aktiengesellschaft, Munich (DE)

( * ) Notice: Subject to any disclaimer, the term of this patent is extended or adjusted under 35 U.S.C. 154(b) by 0 days.

(21) Appl. No.: 17/270,905

(22) PCT Filed: Oct. 11, 2019

(86) PCT No.: PCT/EP2019/077604

§ 371 (c)(1),
(2) Date: Feb. 24, 2021

(87) PCT Pub. No.: WO2020/094330

PCT Pub. Date: May 14, 2020

(65) Prior Publication Data

US 2021/0213512 A1 Jul. 15, 2021

(30) Foreign Application Priority Data

Nov. 9, 2018 (DE) ..... 10 2018 128 020.3

(51) Int. Cl.
*B22D 15/02* (2006.01)
*B22C 9/06* (2006.01)
(Continued)

(52) U.S. Cl.
CPC ..... *B22C 9/06* (2013.01); *B22C 9/04* (2013.01); *B22C 9/22* (2013.01); *B22C 15/02* (2013.01); *B22D 15/02* (2013.01)

(58) Field of Classification Search
CPC ..... B22D 15/02; B22C 9/06; B22C 9/22
See application file for complete search history.

(56) References Cited

U.S. PATENT DOCUMENTS

2002/0185250 A1 12/2002 Shade
2005/0189083 A1* 9/2005 Stahl, Jr. ..... B22C 9/086 164/58.1

(Continued)

FOREIGN PATENT DOCUMENTS

AT 387 164 B 12/1988
CN 205008543 U 2/2016

(Continued)

OTHER PUBLICATIONS

International Search Report (PCT/ISA/210) issued in PCT Application No. PCT/EP2019/077604 dated Dec. 12, 2019 with English translation (four (4) pages).

(Continued)

*Primary Examiner* — Kevin E Yoon
(74) *Attorney, Agent, or Firm* — Crowell & Moring LLP

(57) ABSTRACT

A permanent mold has a base made of metal. The base has a plurality of first mold portions, which are mutually spaced along a longitudinal axis and which are designed to shape a bearing tunnel of a crankcase. Second mold portions are arranged on the first mold portions and consist of a mold material.

13 Claims, 2 Drawing Sheets

(51) Int. Cl.

| | |
|---|---|
| ***B22C 9/22*** | (2006.01) |
| ***B22C 9/04*** | (2006.01) |
| ***B22C 15/02*** | (2006.01) |

(56) References Cited

U.S. PATENT DOCUMENTS

| | | | | |
|---|---|---|---|---|
| 2005/0269054 | A1* | 12/2005 | Newcomb ..... | B22C 9/10 164/351 |
| 2007/0163744 | A1 | 7/2007 | Douro et al. | |
| 2015/0352631 | A1 | 12/2015 | Meishner et al. | |
| 2019/0337047 | A1 | 11/2019 | Klaus et al. | |

FOREIGN PATENT DOCUMENTS

| | | | |
|---|---|---|---|
| DE | 93 15 991 | U1 | 2/1994 |
| DE | 198 03 866 | A1 | 8/1999 |
| DE | 102 25 666 | A1 | 12/2002 |
| DE | 10 2007 002 208 | A1 | 8/2007 |
| DE | 10 2006 061 653 | A1 | 7/2008 |
| DE | 10 2011 105 389 | A1 | 12/2012 |
| DE | 10 2012 106 082 | A1 | 1/2014 |
| DE | 10 2017 100 805 | A1 | 7/2018 |
| EP | 2 738 377 | A2 | 6/2014 |
| JP | 61-144262 | A | 7/1986 |
| WO | WO 2010/130911 | A1 | 11/2010 |
| WO | WO 2014/111573 | A1 | 7/2014 |

OTHER PUBLICATIONS

German-language Written Opinion (PCT/ISA/237) issued in PCT Application No. PCT/EP2019/077604 dated Dec. 12, 2019 (five (5) pages).

German-language Search Report issued in German Application No. 10 2018 128 020.3 dated Jun. 28, 2019 with partial English translation (18 pages).

* cited by examiner

INGOT MOLD AND PROCESS FOR MANUFACTURING A CRANKCASE

BACKGROUND AND SUMMARY OF THE INVENTION

The present invention relates to a permanent mold, and also to a method for producing a crankcase of an internal combustion engine.

Permanent molds are reusable molds for the casting of metals and alloys. Cylinder crankcases, in particular, of internal combustion engines are often produced by means of permanent mold casting processes. Permanent molds of this kind generally comprise a metallic base plate and corresponding front or side slides which in particular form an outer form of the subsequent cast component. In addition, in order to realize cavities, etc., use can also be made of cores. It is often the case that the metallic base plates are used to form the crank chamber of the cylinder crankcase.

In this context, DE 10 2006 061 653 A1 shows, by way of example, a special insert for a base plate, wherein the base plate insert forms, or at least helps to form, the crank chamber of the cast component. Irrespective of whether the base plate as such is of one-part configuration or has inserts as in the aforementioned laid-open application, a system-related disadvantage is that the need for draft angles, since a permanent mold is involved, restricts the freedom of design.

It is therefore an object of the present invention to provide a permanent mold and a method for producing a crankcase which increase the freedom of design and thus in particular also afford new possibilities for achieving weight savings.

The object is achieved by a permanent mold and by a method according to the independent claims. Further advantages and features emerge from the dependent claims and the description and the attached figures.

According to the invention, a permanent mold comprises a base plate made of metal, wherein the base plate has a plurality of first mold portions which are arranged spaced apart from one another along a longitudinal axis and are designed to form a bearing channel or a bearing seat of a (cylinder) crankcase of an internal combustion engine, and wherein second mold portions made of a mold material are arranged on the first mold portions. The permanent mold as such is thus designed or shaped in such a way that the base plate forms, or at least helps to form, a crank chamber of the subsequent cylinder crankcase. In this case, the crank chamber comprises the aforementioned bearing channel or the bearing seat which is provided for the arrangement of the crankshaft. The bearing seat is formed in this case by a plurality of walls which extend along a vertical axis or cylinder axis and which have or form, or at least preform, the corresponding bearing points for the crankshaft. The second mold portions made of a non-metallic material or made of a mold material are advantageously then arranged on the first mold portions, as a result of which the bearing seat or the bearing channel or the aforementioned walls are formed not only by means of a permanent mold but also by lost mold portions, namely the second mold portions, which make a corresponding freedom of design possible.

The mold material expediently comprises a mold base material such as quartz, chromite sand, zircon sand and other sands, binders such as clay, water glass or chemical binders, and possibly additives such as release agents.

According to a preferred embodiment, the second mold portions have protrusions which are designed to generate material recesses, undercuts and cutouts, etc., in the bearing channel. It is thus advantageously possible for the bearing seat geometry to be back-molded directly in the casting operation. As an alternative or in addition, it is also possible for the second mold portions to have recesses in order to generate material protrusions in the bearing seat in a targeted manner, the material protrusions serving for reinforcement, for example. According to one embodiment, the second mold portions comprise protrusions and/or recesses in order to give the bearing seat an in particular loading-appropriate shape. In this case, the protrusions and/or recesses extend in particular along the aforementioned longitudinal axis. According to one embodiment, a protrusion can also be shaped in such a way that it directly forms an opening in the wall or in the bearing channel.

According to one embodiment, the first mold portions have arrangement surfaces on which the second mold portions are arranged or rest. According to one embodiment, the arrangement surfaces lie in a plane. However, the arrangement surfaces can also be arranged along the vertical axis or along the cylinder axis with an offset or also in an inclined manner and/or also in an oblique manner. According to one embodiment, the base plate is, or the first mold portions are, mechanically machined in order to form the arrangement surfaces. According to one embodiment, the arrangement surfaces as such are of planar or flat configuration, which both simplifies the production and makes the arrangement of the second mold portions easier. As an alternative, however, the arrangement surfaces can also have a non-flat form, for example form a radius, etc. In other words, the arrangement surfaces are in particular bearing surfaces on which the first mold portions rest. According to one embodiment, the arrangement surfaces are formed, and/or oriented relative to one another, in such a way that the second mold portions are arranged in the plane in a form-fitting manner, as a result of which secure positioning can be ensured and potentially incorrect orientation can be avoided.

Expediently, the plane is positioned perpendicularly with respect to the vertical axis or the plane is perpendicular to the vertical axis, wherein the vertical axis corresponds to the cylinder axis. This entails the advantage that the second mold portions are held or at least pre-positioned on the first mold portions by way of gravity alone. In this case, however, it is entirely possible, where necessary, for the second mold portions to be held down in a suitable manner, for example by means of other cores.

According to one embodiment, the arrangement surfaces have form-fit elements which prevent a displacement of the second mold portions, in particular in the plane. In other words, the arrangement surface or the arrangement surfaces can have protrusions and/or recesses and/or be provided with a structure which prevents slippage of the second mold portions or ensures exact or desired positioning of the mold portions. In this case, the form-fit elements can also be formed during the production of the arrangement surfaces.

According to one embodiment, the form-fit elements are, for example, one or more grooves or webs which are located on the arrangement surface or surfaces, wherein the second mold portions have a correspondingly congruent structure in which the grooves or webs can engage.

According to one embodiment, the second mold portions are connected via one or more connecting webs which are designed to form openings in the bearing seat or in the bearing channel. Expediently, it is thus possible for one or more ventilation openings to be formed in the bearing seat.

According to one embodiment, in each case two second mold portions are connected via two connecting webs. Expediently, a core is provided which has a plurality of second mold portions, wherein the mold portions are connected via one or more connecting webs.

According to one embodiment, the second mold portions have core marks, which are provided for the arrangement of further cores, such as, for example, one or more feeder cores.

The invention also relates to a method for producing a crankcase, comprising the steps of:

providing a base plate made of metal, the base plate in certain regions or in part forming a bearing seat of a crankcase;

supplementing the base plate by way of the arrangement of second mold portions made of mold material.

The "supplementing" is in particular understood to mean completing the form of the base plate. A simple possibility for optimizing the shape of the crank chamber or in particular of a bearing channel of a cylinder crankcase of an internal combustion engine is thus advantageously provided. The mechanical machining, which is for example required in order to form cutouts or ventilation openings in a bearing seat, can be significantly reduced or even completely omitted. The cutting volume can thus advantageously be reduced. Draft angles can be omitted or reduced.

According to one embodiment, the method comprises the steps of:

providing a base plate made of metal, the base plate forming a bearing seat of a crankcase;

partially removing the base plate and restoring the original form by way of the arrangement of second mold portions made of a mold material.

Advantageously, existing molds may be effectively converted in simple fashion. The advantages and features mentioned in conjunction with the permanent mold also apply analogously and correspondingly for the method, and vice versa.

Further advantages and features emerge from the following description of various embodiments of permanent molds or the constituent parts thereof with reference to the attached figures.

DETAILED DESCRIPTION OF THE DRAWINGS

Figure 1:
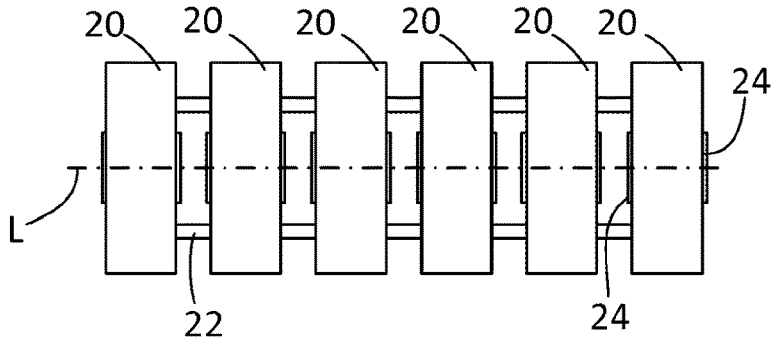
FIG. 1 is a plan view of a core comprising a plurality of second mold portions.

FIG. 1 shows a plan view of a core comprising a plurality of second mold portions 20, wherein the second mold portions 20 are connected by a plurality of connecting webs 22. Reference designation L denotes a longitudinal axis, wherein the longitudinal axis can also be regarded as an axis of rotation of a crankshaft. It is then schematically illustrated that protrusions 24 extend, so to speak, along the longitudinal axis L, the protrusions being designed to form material recesses in a bearing seat or in a bearing channel of a crankcase.

Figure 2:
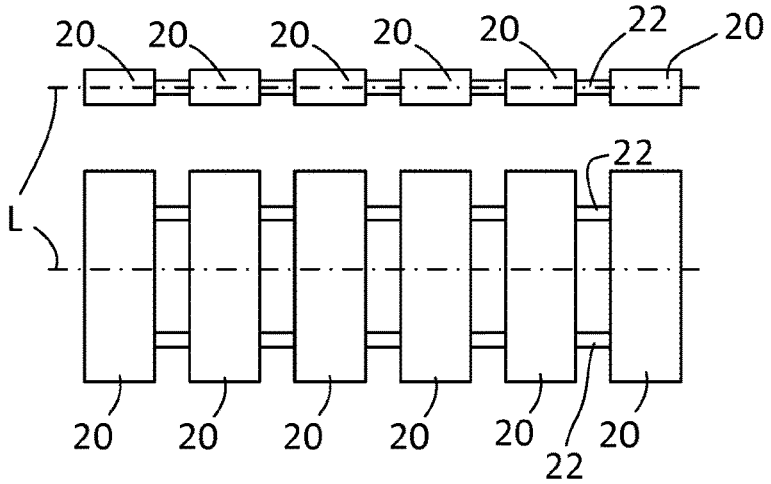
FIG. 2 is a plan view, and a side view, of a further embodiment of a core comprising a plurality of second mold portions.

FIG. 2 shows substantially that embodiment of a core which is known from FIG. 1, wherein, in the embodiment shown here, second mold portions 20 have no protrusions. However, here, a side view of the core is shown in the upper half of the image, it being possible to see how the second mold portions 20 are connected via the connecting webs 22 in the side view.

Figure 3:
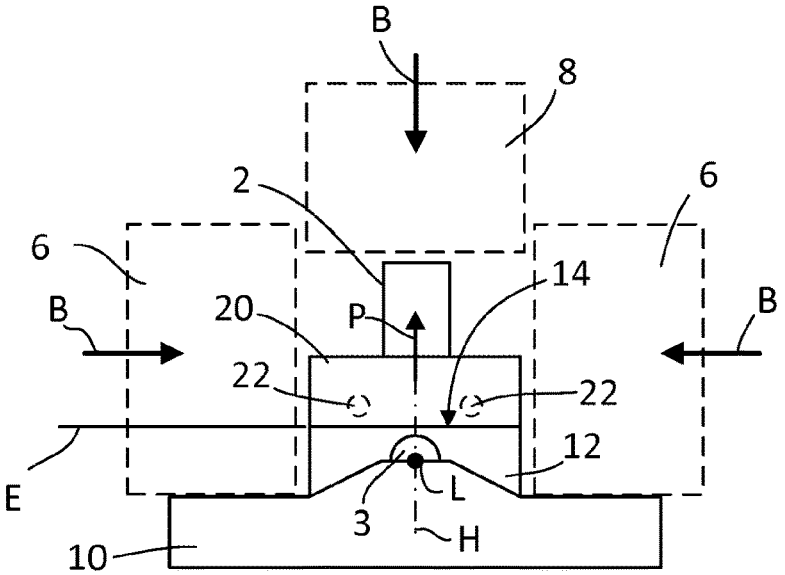
FIG. 3 is a schematic view of one embodiment of a permanent mold.

FIG. 3 shows a schematic view of a permanent mold comprising a metallic base plate 10 which comprises first mold portions 12. A longitudinal axis L is oriented virtually perpendicularly with respect to the plane of the drawing. The permanent mold further comprises two schematically illustrated side slides 6 and a corresponding front slide 8, the directions of movement of the slides being indicated by the arrows sketched with an uppercase B. The first mold portions 12 have arrangement surfaces 14 which are oriented virtually at the end side and toward the top and on which second mold portions 20, see also FIG. 1 and FIG. 2 in this respect, are arranged. Two round connecting webs 22 are illustrated in dashed fashion, the webs being designed, and formed, to generate ventilation openings along the longitudinal axis L in the bearing seat, which is formed substantially by the base plate 10. The arrangement surfaces 14 lie in a plane E, the plane being oriented perpendicularly with respect to a horizontal H. The horizontal H corresponds, so to speak, to a cylinder axis P, the cylinder axis being sketched with an arrow which is correspondingly marked and which points toward the top, virtually in the direction of a combustion chamber. Reference designation 2 denotes a schematically illustrated feeder core. It can also be seen that the first mold portion 12 or the first mold portions 12 forms/form a main bearing 3 for a crankshaft (not illustrated in any more detail here).

Figure 4:
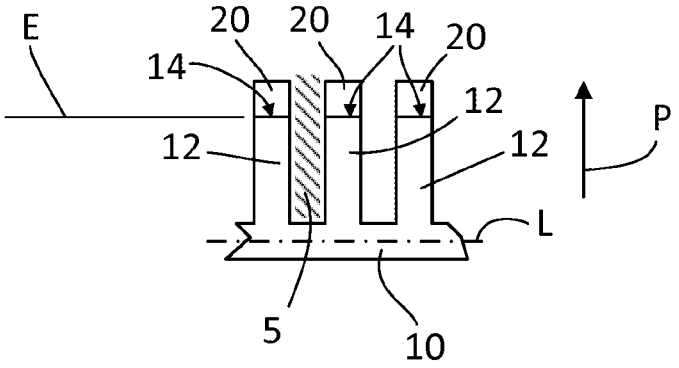
FIG. 4 is a schematic view of one embodiment of a base plate, which forms a bearing seat of a crankcase.

For better understanding, FIG. 4 shows a side view of a base plate 10, it being possible to see that the base plate comprises a plurality of first mold portions 12 which form a bearing seat or a bearing channel. A wall of the bearing seat is illustrated in dashed fashion and is provided with the reference designation 5. It can be seen that the wall 5 is formed not only by the first mold portions 12 but also by the second mold portions 20, which are arranged on corresponding arrangement surfaces 14 of the first mold portions 12. In this case, the first mold portions 12 extend along a horizontal or along a cylinder axis P, the cylinder axis being oriented perpendicularly with respect to a longitudinal axis L which can be understood, so to speak, to be an axis of rotation of a crankshaft (not illustrated here) or which extends along the main bearing of the subsequent crankcase.

LIST OF REFERENCE DESIGNATIONS

2 Feeder core
3 Main bearing
5 Wall
6 Side slide
8 Front slide
10 Mold part, base plate
12 First mold portion
14 Arrangement surface
20 Second mold portion
22 Connecting web
24 Protrusion
E Plane
L Longitudinal axis
H Horizontal, vertical axis
B Direction of movement
P Cylinder axis

What is claimed is:

1. A permanent mold, comprising:

a base plate made of metal, wherein the base plate has a plurality of first mold portions which are arranged spaced apart from one another along a longitudinal axis and are configured to form a bearing channel of a crankcase, and wherein second mold portions, which are formed from a mold material, are arranged on the first mold portions.

2. The permanent mold according to claim 1, wherein the second mold portions have protrusions which are configured to generate material recesses in the bearing channel.

3. The permanent mold according to claim 2, wherein the first mold portions have arrangement surfaces on which the second mold portions are arranged.

4. The permanent mold according to claim 3, wherein the arrangement surfaces lie in a plane.

5. The permanent mold according to claim 1, wherein the first mold portions have arrangement surfaces on which the second mold portions are arranged.

6. The permanent mold according to claim 5, wherein the arrangement surfaces lie in a plane.

7. The permanent mold according to claim 6, wherein the arrangement surfaces have form-fit elements which prevent a displacement of the second mold portions.

8. The permanent mold according to claim 7, wherein the arrangement surfaces have form-fit elements which prevent a displacement of the second mold portions.

9. The permanent mold according to claim 1, wherein the second mold portions are connected via one or more connecting webs which are configured to form openings in the bearing channel.

10. The permanent mold according to claim 9, wherein in each case, two second mold portions are connected via two connecting webs.

11. The permanent mold according to claim 1, wherein in each case, two second mold portions are connected via two connecting webs.

12. The permanent mold according to claim 1, wherein the second mold portions have core marks.

13. A method for producing a crankcase, the method comprising the steps of:

providing a base plate made of metal, wherein the base plate has a plurality of first mold portions arranged spaced apart from one another along a longitudinal axis and are configured to form a bearing channel of a crankcase; and supplementing the base plate by way of an arrangement of second mold portions made of mold material on the first mold portions.

* * * * *